US006497285B2

(12) United States Patent
Walker

(10) Patent No.: US 6,497,285 B2
(45) Date of Patent: Dec. 24, 2002

(54) LOW DEBRIS SHAPED CHARGE PERFORATING APPARATUS AND METHOD FOR USE OF SAME

(75) Inventor: Jerry L. Walker, Fort Worth, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/813,738

(22) Filed: Mar. 21, 2001

(65) Prior Publication Data

US 2002/0134585 A1 Sep. 26, 2002

(51) Int. Cl.[7] ..... E21B 43/117

(52) U.S. Cl. ..... 166/297; 166/55.2; 175/4.6

(58) Field of Search ..... 175/4.5 P, 4.59, 175/4.6, 4.55; 102/312, 321; 166/297, 55.1, 55.2

(56) References Cited

U.S. PATENT DOCUMENTS

| | | | | | |
|---|---|---|---|---|---|
| 2,849,953 | A | * | 9/1958 | Delacour | 175/4.6 |
| 2,947,250 | A | * | 8/1960 | Mohaupt | 175/4.6 |
| 2,994,269 | A | * | 8/1961 | Schlumberger | 175/4.6 X |
| 3,057,295 | A | * | 10/1962 | Christopher | 175/4.6 |
| 3,282,354 | A | * | 11/1966 | Hakala et al. | 175/4.6 |
| 3,429,384 | A | * | 2/1969 | Shore | 175/4.6 |
| 4,191,265 | A | * | 3/1980 | Bosse-Platiere | 175/4.56 |
| 4,312,273 | A | * | 1/1982 | Camp | 175/4.6 X |
| 4,583,602 | A | | 4/1986 | Ayers | 175/4.52 |
| 4,726,431 | A | | 2/1988 | Oestreich et al. | 175/4.6 |
| 4,773,299 | A | | 9/1988 | Oestreich et al. | 89/1.15 |
| 4,832,134 | A | * | 5/1989 | Gill | 175/4.6 |
| 4,960,171 | A | | 10/1990 | Parrott et al. | 166/55 |
| 5,054,564 | A | | 10/1991 | Oestreich et al. | 175/4.6 |
| 5,775,426 | A | | 7/1998 | Snider et al. | 166/308 |

* cited by examiner

*Primary Examiner*—Frank S. Tsay
(74) *Attorney, Agent, or Firm*—Paul I. Herman; Lawrence R. Youst

(57) ABSTRACT

A shaped charge perforating apparatus (50) for perforating a subterranean well is disclosed. The shaped charge perforating apparatus (50) comprises a support member (62) having a plurality of shaped charge mounting locations each having shaped charge (56) positioned therein. Each of the shaped charges (56) has an initiation end and a discharge end. The initiation end of each shaped charge (56) is coupled to a detonator cord (70) The shaped charges (56) are enclosed in a carrier (52) having a plurality of recesses (54) spaced on an exterior surface thereof and having contoured bottom surfaces (80). Each of the recesses (54) is longitudinally and radially aligned with the discharge end of one of the shaped charges (56).

42 Claims, 3 Drawing Sheets

LOW DEBRIS SHAPED CHARGE PERFORATING APPARATUS AND METHOD FOR USE OF SAME

TECHNICAL FIELD OF THE INVENTION

This invention relates, in general, to an apparatus for perforating a subterranean wellbore using shaped charges and, in particular, to a low debris shaped charge perforating apparatus that utilizes contoured recesses in the charge carrier that reduce the size of the holes made in the charge carrier upon detonation of the shaped charges thus enhancing debris containment.

BACKGROUND OF THE INVENTION

Without limiting the scope of the present invention, its background will be described with reference to perforating a subterranean formation with a shape charge perforating apparatus, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, one or more charge carriers are loaded with shaped charges that are connected with a detonating device, such as detonating cord. The charge carriers are then connected within a tool string that is lowered into the cased wellbore at the end of a tubing string, wireline, slick line, coil tubing or the like. Once the charge carriers are properly positioned in the wellbore such that shaped charges are adjacent to the formation to be perforated, the shaped charges are detonated. Upon detonation, each shaped charge creates a Jet that blasts through a scallop or recess in the carrier. Each jet creates a hydraulic opening through the casing and the cement and enters the formation forming a perforation.

When the shaped charges are detonated, numerous metal fragments are created due to, among other things, the disintegration of the metal casings of the shaped charges. These fragments often fall out or are blown out of the holes created in the carrier. As such, these fragments become debris that is left behind in the wellbore. It has been found that this debris can obstruct the passage of tools through the casing during subsequent operations. This is particularly problematic in the long production zones that are perforated in horizontal wells as the debris simply piles up on the lower side of such wells.

A need has therefore arisen for an apparatus and method that reduce the likelihood that debris will be left in the well following perforation of the formation. A need has also arisen for such an apparatus and method that will contain the fragments created when the shaped charges are detonated. Further, a need has arisen for such an apparatus and method that will enhance the performance of the shaped charges in perforating the formation.

SUMMARY OF THE INVENTION

The present invention disclosed herein comprises a shaped charge perforating apparatus and a method for perforating a subterranean formation using a shaped charge perforating apparatus that reduce the likelihood that debris will be left in a well following perforation of a formation. The shaped charge perforating apparatus of the present invention achieves this result by containing the fragments created when the shaped charges are detonated. In addition, the shaped charge perforating apparatus of the present invention enhances the performance of the shaped charges in perforating the formation.

The shaped charge perforating apparatus of the present invention comprises a support member having a plurality of shaped charge mounting locations each of which receive a shaped charge therein. The shaped charges each have an initiation end and a discharge end. The initiation ends of the shaped charges are each coupled to a detonator cord. The shaped charges are placed within an elongated and generally tubular carrier. The carrier has a plurality of recesses that are spaced on the exterior surface thereof and have contoured bottom surfaces. Each of the recesses is axially and radially aligned with the discharge end of one of the shaped charges such that the jet formed upon the initiation of each shaped charge will penetrate the carrier through a recess.

In one embodiment of the present invention, the contoured bottom surface of the recesses is formed such that the center depth of the recess in the carrier is greater than a perimeter depth of the recess. For example, the center depth of the recess may be greater than the perimeter depth of the recess at a point on the perimeter of the recess that is displaced from the center of the recess in a longitudinal direction. Alternatively or additionally, the center depth of the recess may be greater than the perimeter depth of the recess at a point on the perimeter of the recess that is displaced from the center of the recess in a circumferential direction.

In another embodiment of the present invention, the contoured bottom surface of the recesses is formed such that the recesses have a flat bottom portion proximate the center of the recesses and an angular bottom portion extending from the flat bottom portion to the perimeter of the recesses. In this embodiment, the angular bottom portion may have an angle of between about 10 and 40 degrees and may preferably have an angle of between about 15 and 25 degrees.

In one embodiment of the present invention, the contoured bottom surface of the recesses is formed such that the angular bottom portion extends from the flat bottom portion of the recess to the exterior surface of the carrier. In another embodiment of the present invention, the contoured bottom surface of the recesses is formed such that the angular bottom portion of the recess extends from the flat bottom portion of the recess to a sidewall section of the recess at a location offset from the exterior surface of the carrier by a depth.

The method for perforating a subterranean well of the present invention comprises running a shaped charge perforating apparatus of the present invention downhole, operating the shaped charge perforating apparatus and discharging jets formed from the shaped charges through respective contoured bottom surfaces of recesses in the shaped charge carrier. In such a method, the recesses have a center depth that is greater than a perimeter depth, either in the longitudinal direction from the center, the circumferential direction from the center or both. The recesses may have a flat bottom portion proximate the center of the recesses and an angular bottom portion extending from the flat bottom portion to the perimeter of the recesses. The angular bottom portion of the recesses may extend from the flat bottom portion of the recesses to the exterior surface of the carrier or may intersect the sidewall of the recesses at the perimeter of the recesses. In all such configurations, using the method of the present invention to discharge jets formed from the shaped charges through the respective contoured bottom surfaces minimizes the size of openings created through the carrier by the discharge of the jets and prevents peeling of the recesses in the longitudinal direction.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
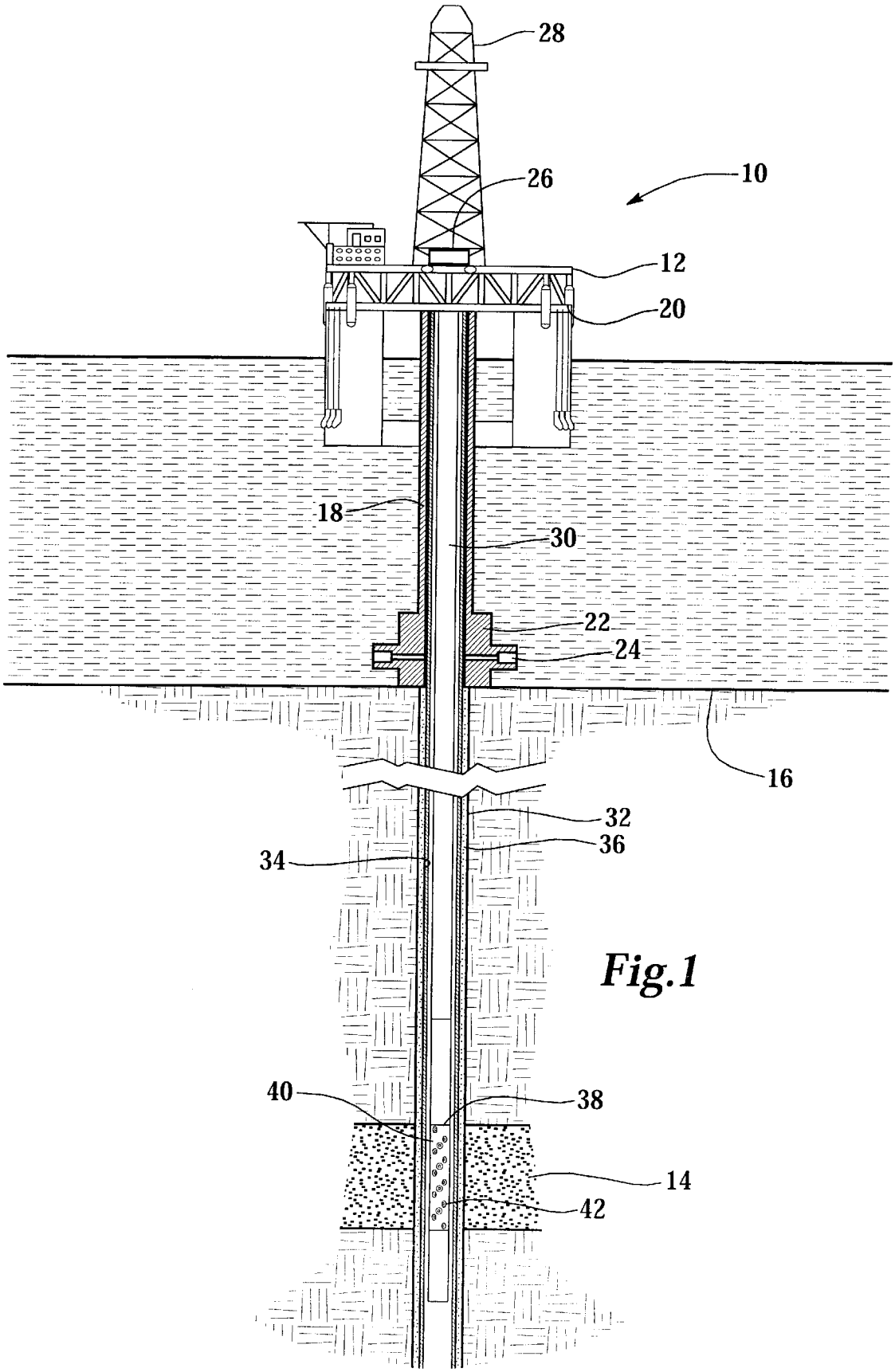
FIG. 1 is a schematic illustration of an offshore oil and gas platform operating a shaped charge perforating apparatus of the present invention.

Referring initially to FIG. 1, a low debris shaped charge perforating apparatus operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 include various tools including shaped charge perforating apparatus 38. When it is desired to perforate formation 14, work string 30 is lowered through casing 34 until shaped charge perforating apparatus 38 is positioned adjacent to formation 14. Thereafter, shaped charge perforating apparatus 38 is fired by detonating the shaped charges that are disposed within charge carrier 40 and aligned with recesses 42 of charge carrier 40. Upon detonation, the liners of the shaped charges form jets that pass through recesses 42 of charge carrier 40 and form a spaced series of perforations extending outwardly through casing 34, cement 36 and into formation 14.

Even though FIG. 1 depicts a vertical well, it should be noted by one skilled in the art that the low debris shaped charge perforating apparatus of the present invention is equally well-suited for use in deviated wells, inclined wells or horizontal wells. Also, even though FIG. 1 depicts an offshore operation, it should be noted by one skilled in the art that the low debris shaped charge perforating apparatus of the present invention is equally well-suited for use in onshore operations.

Figure 2:
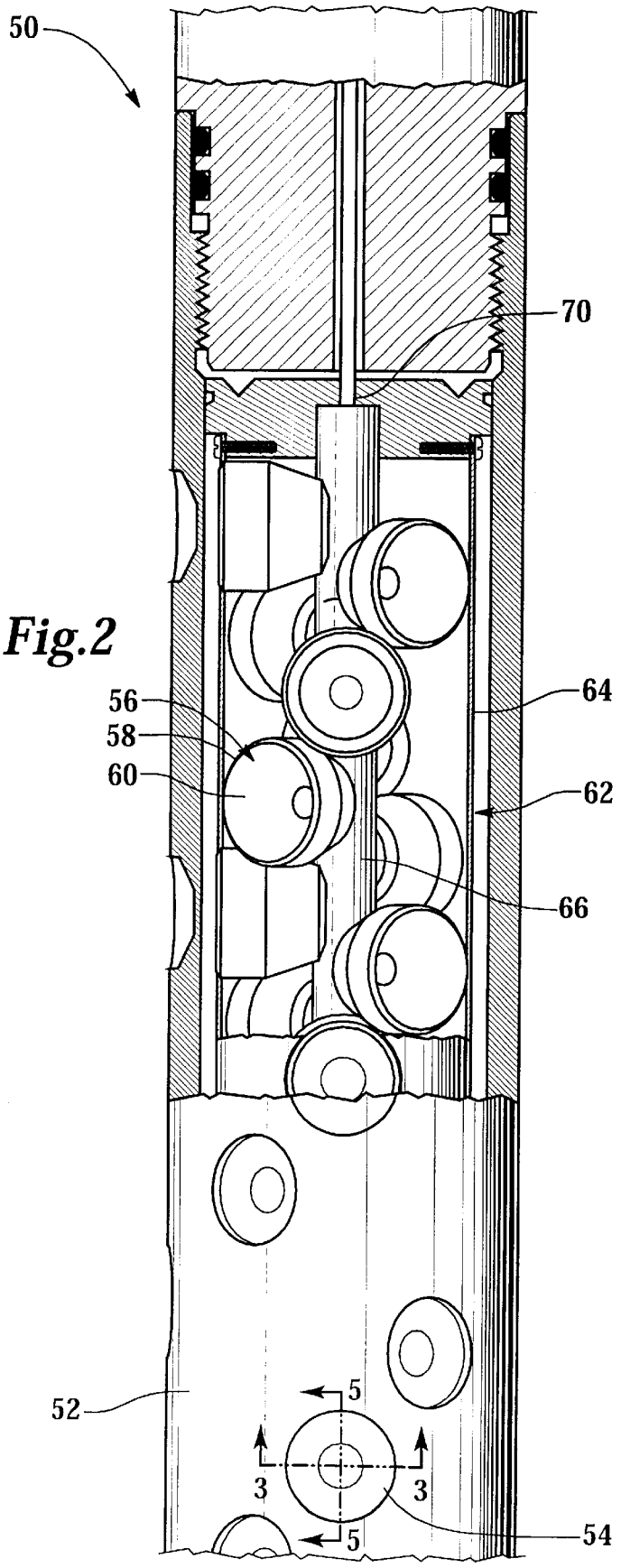
FIG. 2 is partial cut away view of a shaped charge perforating apparatus of the present invention.

Referring now to FIG. 2, therein is depicted a low debris shaped charge perforating apparatus of the present invention that is generally designated 50. Perforating apparatus 50 includes a carrier 52 made of a cylindrical sleeve having a plurality of recesses, such as recess 54, defined therein. Radially aligned with each of the recesses is a respective one of a plurality of shaped charges, such as shaped charge 56. Each of the shaped charges includes an outer housing, such as housing 58 of shaped charge 56, and a liner, such as liner 60 of shaped charge 56. Disposed between each housing and liner is a quantity of high explosive.

The shaped charges are retained within carrier 52 by a support member 62 which includes an outer charge holder sleeve 64, an inner charge holder sleeve 66. In this configuration, outer tube 64 supports the discharge ends of the shaped charges, while inner tube 66 supports the initiation ends of the shaped charges. Disposed within inner tube 66 is a detonator cord 70, such as a Primacord, which is used to detonate the shaped charges. In the illustrated embodiment, the initiation ends of the shaped charges extend across the cental longitudinal axis of perforating apparatus 50 allowing detonator cord 70 to connect to the high explosive within the shaped charges through an aperture defined at the apex of the housings of the shaped charges.

Each of the shaped charges is longitudinally and radially aligned with a recess in carrier 52 when perforating apparatus 50 is fully assembled. In the illustrated embodiment, the shaped charges are arranged in a spiral pattern such that each shaped charge is disposed on its own level or height and is to be individually detonated so that only one shaped charge is fired at a time. It should be noted, however, by those skilled in the art that alternate arrangements of shaped charges may be used, including cluster type designs wherein more than one shaped charge is at the same level and is detonated at the same time, without departing from the principles of the present invention.

Figure 3:
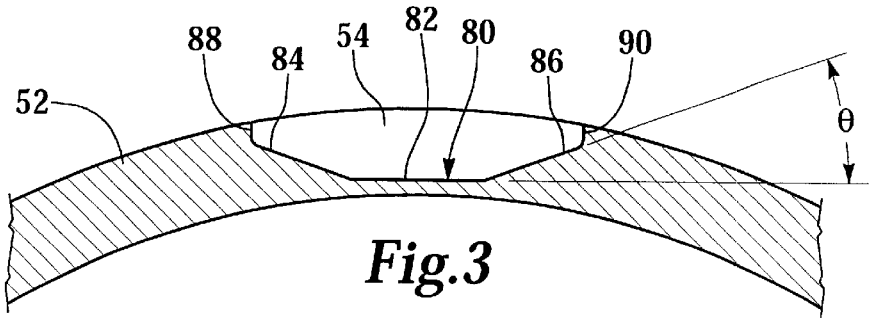
FIG. 3 is a cross sectional view taken in the circumferential direction of a contoured recess of a charge carrier of the present invention taken along line 3—3 of FIG. 2.

Referring now to FIG. 3, therein is depicted a circumferential cross sectional view of recess 54 of carrier 52 taken along line 3—3 of FIG. 2. Recess 54 has a contoured bottom surface 80. In the illustrated embodiment, recess 54 has a flat bottom center portion 82. Radially outwardly extending from flat bottom center portion 82 are angular bottom portions 84 and 86. Angular bottom portion 84 extends radially outwardly toward sidewall 88 of recess 54 while angular bottom portion 86 extends radially outwardly toward sidewall 90 of recess 54. As such, the depth of recess 54 at the center is greater than the depth of recess 54 near the circumferential perimeters of recess 54, i.e., near sidewalls 88 and 90.

In the illustrated embodiment, the angle of angular bottom portions 84 and 86 relative to flat bottom potion 82 is angle θ. Angle θ may be any angle greater than zero but is preferably between 10 degrees and 40 degrees and most preferably between 15 degrees and 25 degrees. The exact angle θ will depend upon the desired performance characteristics of recess 54 as well as the relative diameters of recess 54 and flat bottom portion 82. For example, if recess 54 has a diameter of 1.25 inches, the diameter of flat bottom portion 82 may be between about 0.3 inches and 0.7 inches and is preferable between about 0.4 inches and 0.6 inches. As should be understood by those skilled in the art, other diameter recesses having other diameter flat bottom portions are also desirable and considered within the scope of the present invention.

Figure 4:
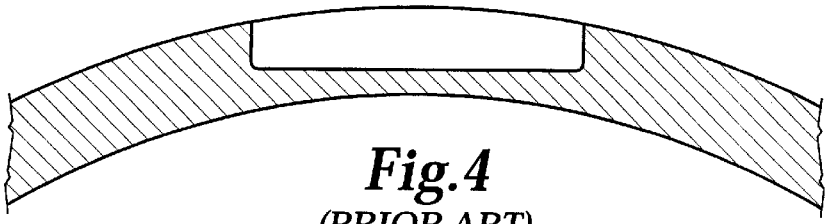
Fig.4 (PRIOR ART)
FIG. 4 is a prior art drawing of a recess of a charge carrier show in a circumferential cross sectional view.

Utilizing a charge carrier having recesses, such as recess 54 with contoured bottom surface 80, enhances the performance of a shaped charge for which recess 54 is the first target. Specifically, as compared with conventional recesses having a flat bottom surface, see FIG. 4, the thickness of the first target is reduced as the depth of recess 54 near the center of recess 54 is greater than the allowable depth for a conventional flat bottom recess due to the required pressure rating for the charge carrier. There must be a sufficient amount of metal remaining behind a recess to withstand the high downhole pressures seen by the charge carrier. Using recess 54 with contoured bottom surface 80, the required pressure rating can be achieved even though the metal behind flat bottom center portion 82 is thinner than previous allowable due to the extra metal behind angular bottom portions 84 and 86. As such, since the first target seen by a shaped charge disposed behind recess 54 having contoured bottom surface 80 is thinner than with conventional flat bottom recesses, the performance of such a shaped charge is improved as the depth of penetration into a formation is increased.

Figure 5:
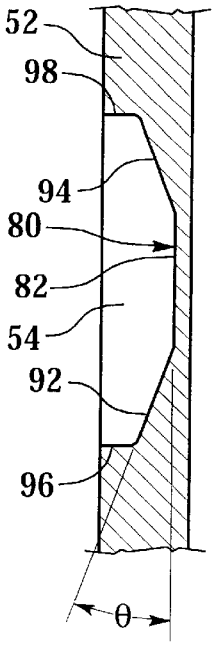
FIG. 5 is a cross sectional view taken in the longitudinal direction of a contoured recess of a charge carrier of the present invention taken along line 5—5 of FIG. 2.

Referring now to FIG. 5, therein is depicted a longitudinal cross sectional view of recess 54 of carrier 52 taken along line 5—5 of FIG. 2. Recess 54 has a contoured bottom surface 80. In the illustrated embodiment, recess 54 has a flat bottom center portion 82. Radially outwardly extending from flat bottom center portion 82 are angular bottom portions 92 and 94. Angular bottom portion 92 extends radially outwardly toward sidewall 96 of recess 54 while angular bottom portion 94 extends radially outwardly toward sidewall 98 of recess 54. As such, the depth of recess 54 at the center is greater than the depth of recess 54 near the longitudinal perimeters of recess 54, i.e., near sidewalls 96 and 98. In the illustrated embodiment, the angle of angular bottom portions 92 and 94 relative to flat bottom center portion 82 is angle θ, which is the same angle of angular bottom portions 84 and 86 relative to flat bottom center portion 82 in FIG. 3 as recess 54 is symmetric about its central axis.

Utilizing a charge carrier having recesses, such as recess 54 with contoured bottom surface 80, not only enhances the performance of shaped charges for which recess 54 is the first target, but also, reduces the likelihood that debris will be left in the well following perforation as such a charge carrier will contain the fragments created when the shaped charges are detonated. Specifically, a smaller opening is made when a jet passes through recess 54 with contoured bottom surface 80 than when a jet passes through conventional recesses. With recess 54, not only does the jet pass through a thinner metal section, contoured bottom surface 80 is not susceptibly to the longitudinal pealing effect as the thickness of the metal behind recess 54 becomes progressive thicker in angular bottom portions 92 and 94.

Figure 6:
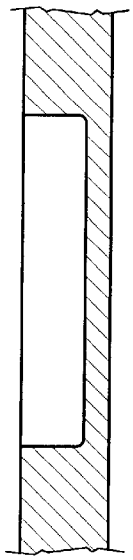
Fig.6 (PRIOR ART)
FIG. 6 is a prior art drawing of a recess of a charge carrier show in a longitudinal cross sectional view.

Unlike the present invention, with conventional flat bottom recesses, as seen in FIG. 6, the thickness of the metal in the longitudinal direction behind the recess is constant. As such, a jet penetrating a conventional flat bottom recess tends to create a large opening as the metal behind the recess peals back toward the sidewalls of the recess. In some cases, this longitudinal pealing effect results in an opening that is substantially as wide as the diameter of the conventional flat bottom recess in the longitudinal direction. As such, the fragments created when the shaped charges are detonated tend to fall or be blasted out of these large openings to become debris in the well. In addition, the pealed section of metal from behind the conventional flat bottom recess sometimes protrudes outwardly beyond the exterior of a charge carrier having conventional flat bottom recesses and scores the casing as such a charge carrier is retrieved uphole.

Figure 7:
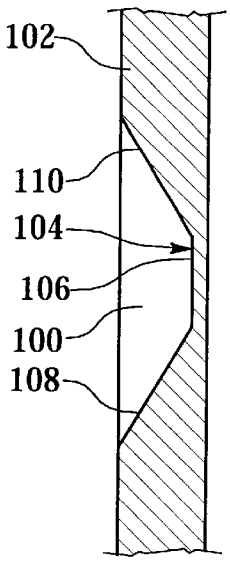
FIG. 7 is a longitudinal cross sectional view of a contoured recess of a charge carrier of the present invention.

Referring now to FIG. 7, therein is depicted a longitudinal cross sectional view of a recess 100 of a carrier 102. Recess 100 has a contoured bottom surface 104. In the illustrated embodiment, recess 100 has a flat bottom center portion 106. Radially outwardly extending from flat bottom center portion 106 are angular bottom portions 108 and 110. Angular bottom portions 108 and 110 extend radially outwardly to the exterior surface of carrier 102. As such, the depth of recess 100 at the center is greater than depth of recess 100 near the longitudinal perimeters of recess 100, i.e., at the intersection with the exterior surface of carrier 102.

Figure 8:
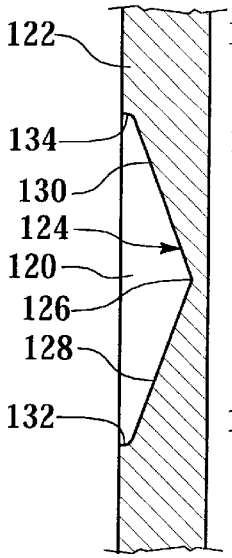
FIG. 8 is a longitudinal cross sectional view of a contoured recess of a charge carrier of the present invention.

Referring next to FIG. 8, therein is depicted a longitudinal cross sectional view of a recess 120 of a carrier 122. Recess 120 has a contoured bottom surface 124. In the illustrated embodiment, recess 120 has an apex 126. Radially outwardly extending from apex 126 are angular bottom portions 128 and 130. Angular bottom portion 128 extends radially outwardly toward sidewall 132 of recess 120 while angular bottom portion 130 extends radially outwardly toward sidewall 134 of recess 120. As such, the depth of recess 120 at the center is greater than the depth of recess 120 near the longitudinal perimeters of recess 120, i.e., near sidewalls 132 and 134.

Figure 9:
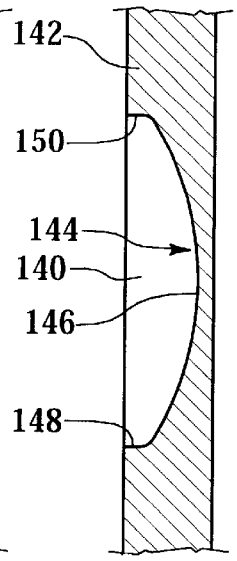
FIG. 9 is a longitudinal cross sectional view of a contoured recess of a charge carrier of the present invention.

Referring to FIG. 9, therein is depicted a longitudinal cross sectional view of a recess 140 of a carrier 142. Recess 140 has a contoured bottom surface 144. In the illustrated embodiment, recess 140 has an arcuate contour that extends from a maximum at location 146 to minimums at sidewalls 148 and 150. As such, the depth of recess 140 at the center is greater than the depth of recess 140 near the longitudinal perimeters of recess 140.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A shaped charge perforating apparatus comprising:

a support member having a plurality of shaped charge mounting locations;

a plurality of shaped charges positioned in the mounting locations of the support member, each of the shaped charges having an initiation end and a discharge end;

a detonator cord operably coupled to the initiation end of each shaped charge; and a carrier having a plurality of recesses spaced on an exterior surface thereof, each of the recesses being longitudinally and radially aligned with the discharge end of one of the shaped charges, the recesses having a flat bottom portion proximate the center of the recesses and an angular bottom portion extending from the flat bottom portion toward the perimeter of the recesses thereby forming a contoured bottom surface of the recesses.

2. The shaped charge perforating apparatus as recited in claim 1 wherein the recesses have a center depth that is greater than a perimeter depth thereby forming the contoured bottom surface of the recesses.

3. The shaped charge perforating apparatus as recited in claim 1 wherein the recesses have a center depth that is greater than a perimeter depth in a longitudinal direction from the center thereby forming the contoured bottom surface of the recesses.

4. The shaped charge perforating apparatus as recited in claim 1 wherein the recesses have a center depth that is greater than a perimeter depth in a circumferential direction from the center thereby forming the contoured bottom surface of the recesses.

5. The shaped charge perforating apparatus as recited in claim 1 wherein the angular bottom portion extending from the flat bottom portion to the perimeter of the recesses has an angle of between about 10 and 40 degrees.

6. The shaped charge perforating apparatus as recited in claim 1 wherein the angular bottom portion extending from the flat bottom portion to the perimeter of the recesses has an angle of between about 15 and 25 degrees.

7. The shaped charge perforating apparatus as recited in claim 1 wherein the angular bottom portion extending from the flat bottom portion to the perimeter of the recesses extends to a sidewall portion of the recesses.

8. The shaped charge perforating apparatus as recited in claim 1 wherein the angular bottom portion extending from the flat bottom portion to the perimeter of the recesses extends to the exterior surface of the carrier.

9. The shaped charge perforating apparatus as recited in claim 1 wherein the recesses have an angular bottom portion that extends from the perimeter of the recesses to the center of the recesses thereby forming the contoured bottom surface of the recesses.

10. The shaped charge perforating apparatus as recited in claim 1 wherein the contoured bottom surface of the recesses further comprises an arcuate contour.

11. A shaped charge perforating apparatus adapted for use in a borehole, comprising:

a plurality of shaped charges each having an initiation end and a discharge end;

a detonator cord operably coupled to the initiation end of each shaped charge; and a carrier enclosing the shaped charges, the carrier including a plurality of recesses corresponding, respectively, to the discharge ends of the plurality of shaped charges, the plurality of recesses having a flat bottom portion proximate the center of the recesses and an angular bottom portion extending from the flat bottom portion toward the perimeter of the recesses thereby forming a contoured bottom surface of the recesses.

12. The shaped charge perforating apparatus as recited in claim 11 wherein the recesses have a center depth that is greater than a perimeter depth thereby forming the contoured bottom surface of the recesses.

13. The shaped charge perforating apparatus as recited in claim 11 wherein the recesses have a center depth that is greater than a perimeter depth in a longitudinal direction from the center thereby forming the contoured bottom surface of the recesses.

14. The shaped charge perforating apparatus as recited in claim 11 wherein the recesses have a center depth that is greater than a perimeter depth in a circumferential direction from the center thereby forming the contoured bottom surface of the recesses.

15. The shaped charge perforating apparatus as recited in claim 11 wherein the angular bottom portion extending from the flat bottom portion to the perimeter of the recesses has an angle of between about 10 and 40 degrees.

16. The shaped charge perforating apparatus as recited in claim 11 wherein the angular bottom portion extending from the flat bottom portion to the perimeter of the recesses has an angle of between about 15 and 25 degrees.

17. The shaped charge perforating apparatus as recited in claim 11 wherein the angular bottom portion extending from the flat bottom portion to the perimeter of the recesses extends to a sidewall portion of the recesses.

18. The shaped charge perforating apparatus as recited in claim 11 wherein the angular bottom portion extending from the flat bottom portion to the perimeter of the recesses extends to the exterior surface of the carrier.

19. The shaped charge perforating apparatus as recited in claim 11 wherein the recesses have an angular bottom portion that extends from the perimeter of the recesses to the center of the recesses thereby forming the contoured bottom surface of the recesses.

20. The shaped charge perforating apparatus as recited in claim 11 wherein the contoured bottom surface of the recesses further comprises an arcuate contour.

21. A carrier for a shaped charge perforating apparatus having a plurality of shaped charges, each of the shaped charges having an initiation end and a discharge end and a detonator cord coupled to the initiation end of each shaped charge, the carrier comprising:

an elongated tubular member having a plurality of recesses spaced on an exterior surface thereof, each of the recesses being longitudinally and radially aligned with the discharge end of one of the shaped charges, the recesses having a flat bottom portion proximate the center of the recesses and an angular bottom portion extending from the flat bottom portion toward the perimeter of the recesses thereby forming a contoured bottom surface of the recesses.

22. The shaped charge perforating apparatus as recited in claim 21 wherein the recesses have a center depth that is greater than a perimeter depth thereby forming the contoured bottom surface of the recesses.

23. The shaped charge perforating apparatus as recited in claim 21 wherein the recesses have a center depth that is greater than a perimeter depth in a longitudinal direction from the center thereby forming the contoured bottom surface of the recesses.

24. The shaped charge perforating apparatus as recited in claim 21 wherein the recesses have a center depth that is greater than a perimeter depth in a circumferential direction from the center thereby forming the contoured bottom surface of the recesses.

25. The shaped charge perforating apparatus as recited in claim 21 wherein the angular bottom portion extending from the flat bottom portion to the perimeter of the recesses has an angle of between about 10 and 40 degrees.

26. The shaped charge perforating apparatus as recited in claim 21 wherein the angular bottom portion extending from the flat bottom portion to the perimeter of the recesses has an angle of between about 15 and 25 degrees.

27. The shaped charge perforating apparatus as recited in claim 21 wherein the angular bottom portion extending from the flat bottom portion to the perimeter of the recesses extends to a sidewall portion of the recesses.

28. The shaped charge perforating apparatus as recited in claim 21 wherein the angular bottom portion extending from the flat bottom portion to the perimeter of the recesses extends to the exterior surface of the carrier.

29. The shaped charge perforating apparatus as recited in claim 21 wherein the recesses have an angular bottom portion that extends from the perimeter of the recesses to the center of the recesses thereby forming the contoured bottom surface of the recesses.

30. The shaped charge perforating apparatus as recited in claim 21 wherein the contoured bottom surface of the recesses further comprises an arcuate contour.

31. A method for perforating a subterranean well comprising the steps of:

running downhole a shaped charge perforating apparatus having a plurality of shaped charges that are enclosed in a carrier having a plurality of recesses corresponding, respectively, to the plurality of shaped charges, the recesses having contoured bottom surfaces with a flat bottom portion proximate the center of the recesses and an angular bottom portion extending from the flat bottom portion toward the perimeter of the recesses;

detonating the shaped charges; and discharging jets formed from the shaped charges through the respective contoured bottom surfaces of the recesses in the carrier.

32. The method as recited in claim 31 wherein the step of discharging jets further comprises discharging jets formed from the shaped charges through the respective recesses in the carrier wherein the recesses have a center depth that is greater than a perimeter depth.

33. The method as recited in claim 31 wherein the step of discharging jets further comprises discharging jets formed from the shaped charges through the respective recesses in the carrier wherein the recesses have a center depth that is greater than a perimeter depth in a longitudinal direction from the center.

34. The method as recited in claim 31 wherein the step of discharging jets further comprises discharging jets formed from the shaped charges through the respective recesses in the carrier wherein the recesses have a center depth that is greater than a perimeter depth in a circumferential direction from the center.

35. The method as recited in claim 31 wherein the angular bottom portion extending from the flat bottom portion to the perimeter of the recesses has an angle of between about 10 and 40 degrees.

36. The method as recited in claim 31 wherein the angular bottom portion extending from the flat bottom portion to the perimeter of the recesses has an angle of between about 15 and 25 degrees.

37. The method as recited in claim 31 wherein the angular bottom portion extending from the flat bottom portion to the perimeter of the recesses extends to a sidewall portion of the recesses.

38. The method as recited in claim 31 wherein the angular bottom portion extending from the flat bottom portion to the perimeter of the recesses extends to an exterior surface of the carrier.

39. The method as recited in claim 31 wherein the recesses have an angular bottom portion that extends from the perimeter of the recesses to the center of the recesses.

40. The method as recited in claim 31 wherein the contoured bottom surface of the recesses further comprises an arcuate contour.

41. The method as recited in claim 31 wherein the step of discharging jets formed from the shaped charges through the respective contoured bottom surfaces of the recesses further comprises minimizing the size of openings created by the discharge of the jets.

42. The method as recited in claim 31 wherein the step of discharging jets formed from the shaped charges through the respective contoured bottom surfaces of the recesses further comprises preventing peeling of the recesses in the longitudinal direction.

* * * * *